US005888081A

United States Patent [19]

Konoya et al.

[11] Patent Number: 5,888,081

[45] Date of Patent: Mar. 30, 1999

[54] LEVER CONNECTOR

[75] Inventors: Hisashi Konoya; Hajime Kawase; Masaaki Tabata, all of Yokkaichi, Japan

[73] Assignee: Sumitomo Wiring Systems Inc., Japan

[21] Appl. No.: 905,992

[22] Filed: Aug. 5, 1997

[30] Foreign Application Priority Data

Aug. 8, 1996 [JP] Japan ..... 8-210242
Aug. 8, 1996 [JP] Japan ..... 8-210243

[51] Int. Cl.[6] ..... H01R 13/62

[52] U.S. Cl. ..... 439/157

[58] Field of Search ..... 439/157, 310, 439/372

[56] References Cited

U.S. PATENT DOCUMENTS 5,077,722 12/1991 Geist et al. ..... 439/157
5,135,410 8/1992 Kawase et al. .

FOREIGN PATENT DOCUMENTS 0 616 391 3/1994 European Pat. Off. .
0 655 799 5/1995 European Pat. Off. .
38 26 332 8/1989 Germany .
94 18 018 4/1996 Germany .

*Primary Examiner*—Neil Abrams
*Assistant Examiner*—Javaid Nasri
*Attorney, Agent, or Firm*—Anthony J. Casella; Gerald E. Hespos; Ludomir A. Budzyn

[57] ABSTRACT

A lever 30 is mounted on a female connector housing 20 such that a part of the lever 30 is accommodated in a receptacle 11 of a male connector housing 10 together with a female connector housing 20 in a connected state of the male and female connector housings 10, 20. Thus, a movement of the lever in its opening direction is restricted by an outer wall of the receptacle 11, eliminating the need to provide a protection wall for preventing the disengagement of the lever 30 in the connected state. This results in a reduced size of the lever connector. Further, the lever 30 is formed in its outer surfaces with cam grooves 33 in the form of recesses. Thus, a mold for the lever 30 can be pulled outward, enabling the simplification of the construction thereof.

16 Claims, 5 Drawing Sheets

LEVER CONNECTOR

BACKGROUND OF THE INVENTION

1. Field of the Invention

The present invention relates to a lever connector which connects first and second connector housings by cam action.

2. Description of the Prior Art

A known lever connector, as shown in FIG. 7, includes a lever 1 mounted on a male connector housing 2. The male connector housing 2 is mateable with a female connector housing 3. More particularly, the male connector housing 2 includes a receptacle 4 for accommodating the female connector housing 3. The receptacle 4 is formed by outer walls 5 of the male connector housing 2, and the lever 1 is mounted over the outer walls 5. Protection walls 6 are formed to cover a part of the lever 1 to prevent the disengagement of the lever 1 from the male connector housing 2. Further, the lever 1 is formed with cam grooves 8 engageable with engaging pins 7 projecting from the female connector housing 3.

The male and female connector housings 2, 3 are connected by fitting the engaging pins 7 of the female connector housing 3 into the cam grooves 8 of the lever 1 and rotating the lever 1 thereafter. As the lever 1 is rotated, the engaging pins 7 are guided along the cam grooves 8, displacing the male and female connector housings 2, 3 to their connection positions.

In the connected state of the male and female connector housings 2, 3 where the female connector housing 3 is fitted in the receptacle 4, the outer walls 5 of the receptacle 4, the lever 1 and the protection walls 6 are located in this order one after another outside the female connector housing 3. This, as a whole, makes the connector larger.

In view of the above problems, it is an object of the present invention to provide a lever connector which has a smaller size.

SUMMARY OF THE INVENTION

According to the invention, there is provided a lever connector, comprising first and second connector housings connectable with each other. The first and second connector housings may define male and female connector housings respectively. A lever having at least one cam groove is provided at or on the second connector housing, and at least one engaging pin, projection or engaging means which is provided at or on the first connector housing and is engageable with or insertable into the cam groove. The first and second connector housings are connectable by the cam effect of the at least one engaging pin and the at least one cam groove during the displacement or rotation or pivotal movement of the lever. The at least one engaging pin is so formed as to project from a wall surface of a receptacle of the first connector housing for accommodating the second connector housing and at least a part of the lever is accommodated in the receptacle as the first and second connector housings are connected.

Thus the cam effect assists the engagement and/or disengagement of the first and second connectors by displacing the engaging pin upon rotation of the lever.

According to a preferred embodiment of the invention, the lever is mounted outside the second connector housing and/or the cam groove is a recess formed in a surface, preferably in an outer surface of the lever.

Accordingly, there is provided a lever connector which is manufacturable with a mold having a simple construction, since it can be avoided that each cam groove is a through hole as in the construction according to the prior art. According to the known construction, at an edge 8*a* (upper edge in FIG. 7) of the cam groove 8 at the side into which the corresponding engaging pin 7 is inserted, the inner surface is indented while leaving the outer surface as it is to ensure a specific strength. Thus, a mold for the cam groove 8 according to prior art needs to be so fabricated as to dent the inner surface, disadvantageously making the construction of the mold complicated. This disadvantage is avoided by the lever connector according to this preferred embodiment.

Preferably, the lever is pivotally or pivotably supported, preferably on a mount pin provided at or on the second connector housing. Thus the lever connector can be easily connected by means of the cam action in combination with a favorable lever action.

Further preferably, the cam groove has such a configuration, that its distance to the pivot center is variable in an azimuthal or circumferential direction.

Still further preferably, holding or locking means are provided at the first connector housing, the second connector housing and/or the lever for holding or locking or securing the lever in a predetermined or predeterminable position. Thus the lever can be firmly positioned in a predetermined or predeterminable position, in particular in its connection position, thus avoiding any accidental misplacement or displacement thereof.

Most preferably, the first and second connector housings comprise tilt or wrench or wedge prevention means, which prevent a tilting or wrenching or wedging or sticking of the connector housing during their connection or coupling. Thus an easy connection is ensured.

According to a further preferred embodiment of the invention, the lever connector further comprises a retainer which is provided on one outer side surface of the first and/or second connector housing, preferably including the longer sides of an engaging surface. Thus there is provided a lever connector of side retainer type having a small size.

Preferably, the retainer is held in a position where it slightly projects from said outer side surface, in particular in a partly locked position thereof.

Further preferably, the retainer is formed with a recess portion for avoiding the interference with the lever in the partly locked position thereof.

Most preferably, the lever is so mounted as to hold a side surface of the second connector housing, where the retainer is mounted, and a side surface opposite thereto.

According to a further aspect of the invention, there is provided a lever connector first and second connector housings connectable with each other. The first and second connector housing may be male and female connector housings respectively. A lever having at least one cam groove is provided at or on the second connector housing. At least one engaging pin is provided at or on the first connector housing and is engageable with the cam groove. The first and second connector housings are connectable by the cam effect of the at least one engaging pin and the at least one cam groove during the displacement or rotation or pivotal movement of the lever. The cam groove preferably is a recess formed in a surface, preferably an outer surface, of the lever.

Accordingly there is provided a lever connector which is manufacturable with a mold having a simple construction.

According to a further preferred embodiment of the invention, a lever connector comprises male and female connector housings connectable with each other. A lever having a cam groove is provided at one of the male and female connector housings. An engaging pin is provided at the other of the male and female connector housings and is engageable with the cam groove. The male and female connector housings are connected by the cam effect of the engaging pin and the cam groove during the rotation of the lever. The lever is preferably mounted outside the female connector housing and the cam groove is preferably a recess formed in an outer surface of the lever. The engaging pin is so formed as to project from a wall surface of a receptacle of the male connector housing for accommodating the female connector housing, and a part of the lever is accommodated in the receptacle as the male and female connector housings are connected.

Accordingly, the lever is mounted on the female connector housing. When the male and female connector housings are connected, a part of the lever is accommodated in the receptacle of the male connector housing together with the female connector housing. Accordingly, it is not necessary to provide a protection wall for preventing the disengagement of the lever in the connected state. As a result, the lever connector according to this embodiment can be made smaller than the prior art by omitting the protection wall from the construction. Further, in this embodiment, since the cam grooves preferably are recesses formed in the outer surfaces of the lever, a mold for the cam grooves can be pulled outwardly. This enables the construction of the mold to be simplified. Furthermore, since the cam grooves are recesses in their entirety, not through holes as in the prior art, the strength of the lever is not substantially degraded by the formation of the cam grooves.

According to still a further aspect of the invention, the lever connector comprises a connector housing having a flat box shape whose dimensions when viewed from an engaging surface with a mating connector housing differ. A lever is so mounted as to hold the connector housing therebetween. A retainer is provided on one outer side surface of the connector housing including the longer sides of the engaging surface, and is held in a position where it slightly projects from said outer side surface in a partly locked position. The connector housings are displaced to their connection positions by the rotation of the lever. The lever is so mounted as to hold the side surface where the retainer is mounted and a side surface opposite thereto and is formed with a recess portion for avoiding the interference with the lever in the partly locked position.

According to the invention, since the retainer is formed with the recess portion, even if the lever is so mounted as to hold the side surface where the retainer is mounted and the side surface opposite thereto from outside, the retainer in its partly locked position does not interfere the lever. Since the lever can be so mounted as to hold the opposite side surfaces including the longer sides of the engaging surface with the mating connector housing from outside, the inventive lever connector is allowed to have a small size.

These and other objects, features and advantages of the present invention will become more apparent upon a reading of the following detailed description and accompanying drawings.

DETAILED DESCRIPTION OF THE PREFERRED EMBODIMENT

Figure 1:
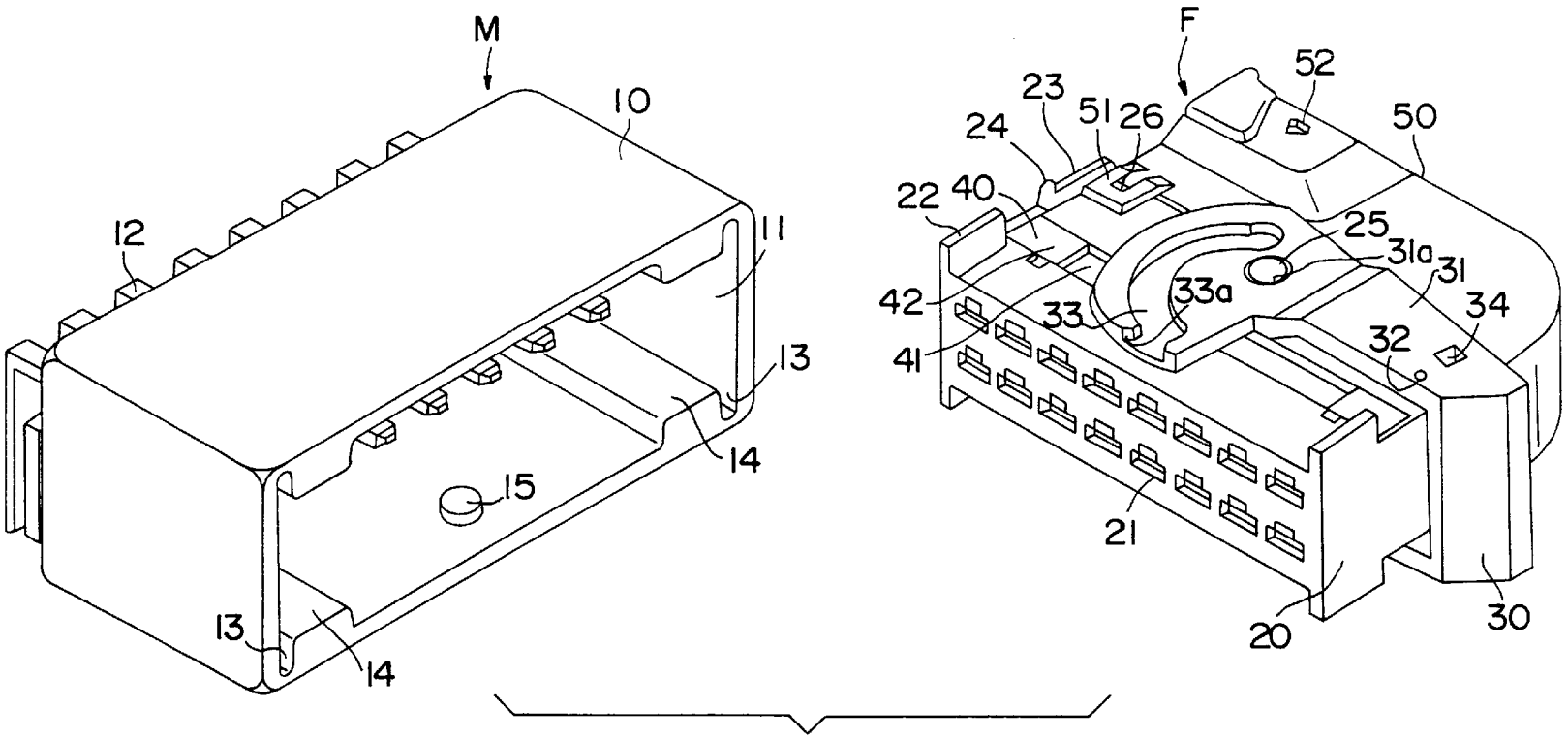
FIG. 1 is a perspective view entirely showing one embodiment of the invention.

With ref erence to FIGS. 1 to 6, a lever connector according to the invention includes a male connector M to be mounted on an unillustrated base board and a female connector F. The male connector M includes a first or male connector housing 10 having a shape of a transversely long rectangular parallelepiped. Inside the male connector M, there is defined a receptacle 11 for accommodating a female connector housing 20. In the male connector housing 10, a plurality of male terminal fittings 12 are arranged spaced from each other, in particular side by side (along a direction from bottom left to top right in FIG. 1) preferably in two vertical rows. At least one end of each male terminal fitting 12 projects into the receptacle 11, and the other end thereof is preferably bent substantially at right angles and is to be connected, in particular soldered, to the base board. Inside the receptacle 11, guide projections 14 are formed at its four corners so as to define guide grooves 13 in cooperation with the opposite side walls (front and back side walls in FIG. 1). Further, a pair of engaging pins 15 project preferably opposite to each other substantially in middle portions of the bottom and ceiling surfaces of the receptacle 11 (only an engaging pin formed on the bottom surface is shown in FIG. 1).

As shown in the right side of FIG. 1, the female connector F includes a second or female connector housing 20 having a shape preferably substantially corresponding to or matching the shape of the male connector housing 10. In particular, the female connector housing is a transversely long substantially rectangular parallelepiped. Inside the female connector F, a plurality of cavities 21 are formed spaced from each other, in particular substantially side by side (along a direction from top left to bottom right in FIG. 1) preferably in two vertical rows. Female terminal fittings 60 (see FIG. 5) are mounted in the cavities 21, and wires connected with the respective female terminal fittings 60 extend in particular through the rear surface (back side in FIG. 1) of the female connector F. Front ends (front side in FIG. 1) of the opposite sides of the upper and lower surfaces (shorter sides of the upper and lower surfaces) of the female connector housing 20 project upwardly and downwardly to form wedge, tilt, sticking or wrench prevention portions 22, (hereinafter wrench preventing portion 22). The wrench prevention portions 22 act to prevent a wedge, tilt, sticking or wrench from occurring while the male and female connector housings 10, 20 are connected by being engaged with the guide grooves 13 of the male connector housing 10.

Figure 2:
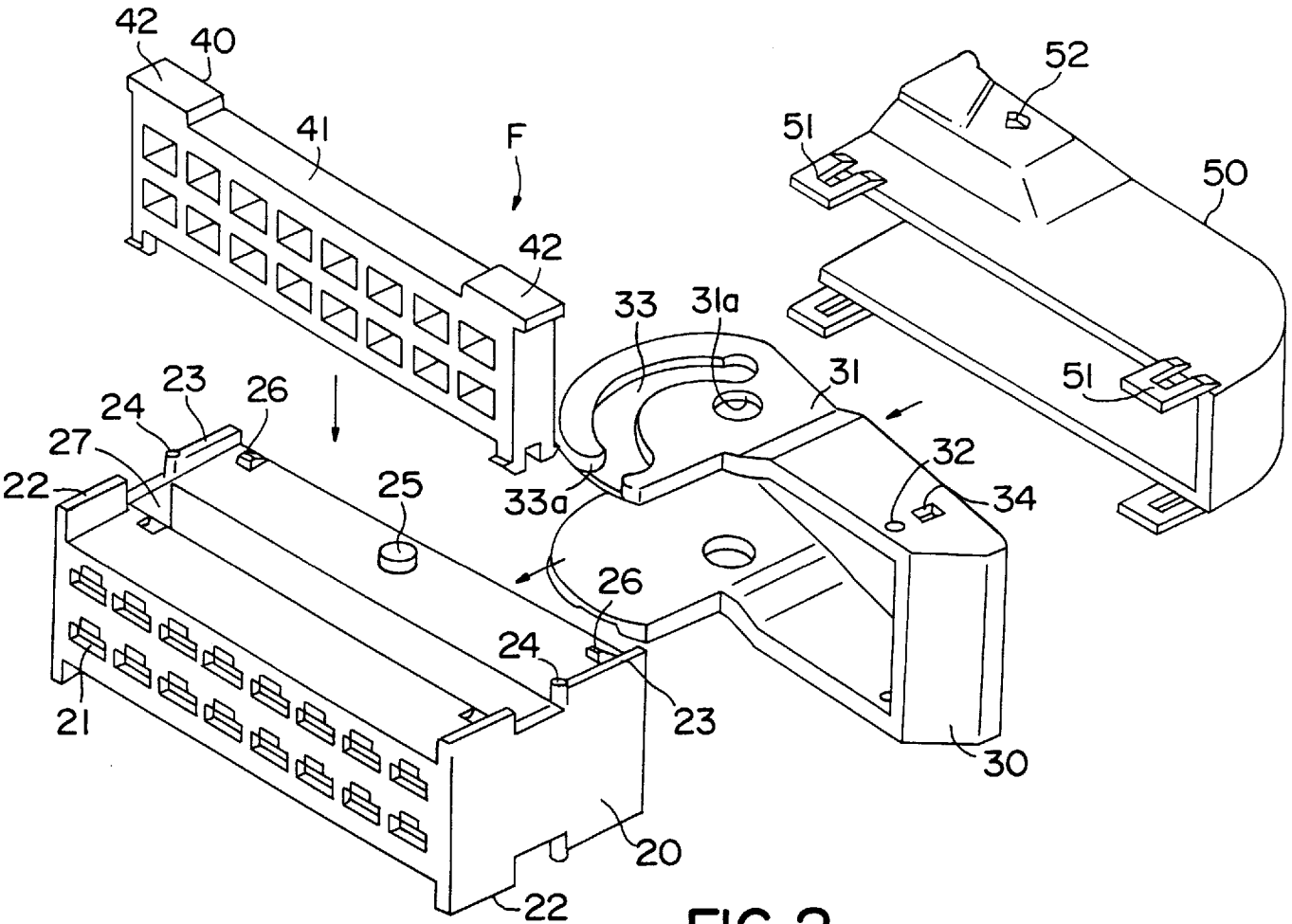
FIG. 2 is an exploded perspective view of a female connector.

Further, as shown in FIG. 2, rear ends of the right edges of the upper and lower surfaces (back parts of the front shorter sides of the upper and lower surfaces in FIG. 2) of the female connector housing 20 also slightly project in a direction substantially equal to the wrench preventing portion 22, in particular upward and downward to form support ribs 23 for supporting an upper end of a lever 30 to be described later while slightly parting it from the upper and lower surfaces. Each support rib 23 is formed with a holding projection 24 fittable into a holding hole 32 of the lever 30. A position where the holding projections 24 and the holding holes 32 are substantially engaged is a standby position of the lever 30. In this embodiment, at the rear ends of the left edges of the upper and lower surfaces of the female connector housing 20, the support ribs 23 and the holding projections 24 are so formed as to be substantially symmetrical with their counterparts at the rear ends of the right edges to hold the lever 30 in its standby position when the lever 30 is so mounted as to face the left side opposite to the orientation of the lever 30 shown in FIG. 2 (facing to the right).

As shown in FIG. 2, the female connector F may be of the retainer type, in particular of the side retainer type, which is provided with a retainer 40 at its side surface (upper surface in FIG. 1) including the longer sides of an engaging surface (front surface in FIG. 1). The female connector housing 20 has in this female connector F a substantially center portion of its upper surface opened or cut away substantially entirely along the transverse direction to have a substantially rectangular cross section, thereby forming a retainer receptacle 27. A retainer 40 preferably in the form of a lattice (in particular corresponding to the cavities 21) is inserted or insertable into the retainer receptacle 27. The upper part of the retainer 40 is recessed, leaving only opposite side portions 42 (top left end and bottom right portions in FIG. 2), thereby forming a recess portion 41 for avoiding the interference with the lever 30. More specifically, the retainer 40 is so held as to slightly project from the upper surface of the female connector housing 20 in a partly locked state. In this state, the recess portion 41 is substantially flush with the upper surface of the female connector housing 20 so as to avoid the interference with a leg 31 of the lever 30. In a fully locked state where the retainer 40 is fully pressed in, the recess portion 41 slightly retracts from the upper surface of the female connector housing 20 and the opposite side portions 42 are flush with the upper surface of the female connector housing 20. Although no reference numeral is given, the retainer 40 is formed with locking claws at its bottom end portion to lockingly hold the retainer 40 in its partly locked position and fully locked position.

Further, as shown in FIG. 2, a cover 50 is mounted on the rear side (back side in FIG. 2) of the female connector housing 20. More specifically, engaging projections 26 are formed preferably at the opposite ends of the upper and lower surfaces at the rear end of the female connector housing 20, whereas engaging members 51 engageable with the corresponding engaging projections 26 project preferably from the upper and lower edges of a front end of the cover 50 (an end at the front side of FIG. 2). A left side surface of the cover 50 is open so that the wires drawn from the respective cavities 21 are or can be bundled and further drawn therethrough. Left side portions of the upper and lower walls of the cover 50 bulge slightly upward, and locking projections 52 engageable with locking holes 34 of the lever 30 are formed there.

The lever 30 has a substantially hollow or U-shaped cross section (illustrated laid to the right in FIG. 2), and is fitted over the female connector housing 20 (in such a manner as to hold the female connector housing 20 from opposite sides along the vertical direction in FIG. 2). More specifically, pivot or mount holes 31*a* are formed in positions opposite to each other in the legs 31 of the lever 30, whereas pivot or mount pins 25 project from the upper and lower surfaces of the female connector housing 20 preferably substantially at the center of the rear end thereof. The lever 30 is mounted or pivotably supported by fitting the respective mount holes 31*a* around the mount pins 25. The holding holes 32 are formed in the upper ends of the respective legs 31 so as to be substantially opposed to each other. By fitting the holding holes 32 around or to the holding projections 24, the lever 30 is held in its standby position (position shown in FIG. 3). The locking holes 34 are formed in the upper ends of the legs 31 so as to be substantially opposed to each other. By fitting the locking holes 34 around the locking projections 52, the lever 30 is held in its connection position (position shown in FIG. 4).

Further, a cam groove or recess 33 is formed in the outer surface of the bottom part of preferably each leg 31 of the lever 30. This cam groove 33 is a substantially arcuate recess extending downwardly (to the left in FIG. 2) from the front end in the standby position of the lever 30 (front side in FIG. 2). As the cam groove 33 extends from the front end to the rear end, it gradually approaches the mount hole 31*a*, i.e. the radial distance between the mount hole 31*a* and the cam groove 33, in particular its interaction surface interacting with the mounting pin 15, is reduced in an azimuthal direction with respect to the center of the mount hole 31*a*, the distance at a given azimuthal position becoming preferably smaller, when the lever 30 is pivoted or displaced toward its connection position. The front end of the cam groove 33 is substantially open to the edge of the lever 30, thereby forming an insertion inlet 33*a*. The engaging pin 15 is insertable or fittable into the cam groove 33 via this insertion inlet 33*a*.

Next, the action of this embodiment is described. The male and female connectors F, M are connected as follows. First, with the lever 30 positioned or held in its standby position, the female connector housing 20 is substantially fitted into the receptacle 11 of the male connector housing 10 in such a manner that the respective wrench prevention portions 22 of the female connector housing 10 are inserted into the guide grooves 13 of the male connector housing 10. Then, the one or more engaging pins 15 of the male connector housing 10 enter the front ends of the cam grooves 33 of the lever 30 through the insertion inlets 33*a*.

Figure 3:
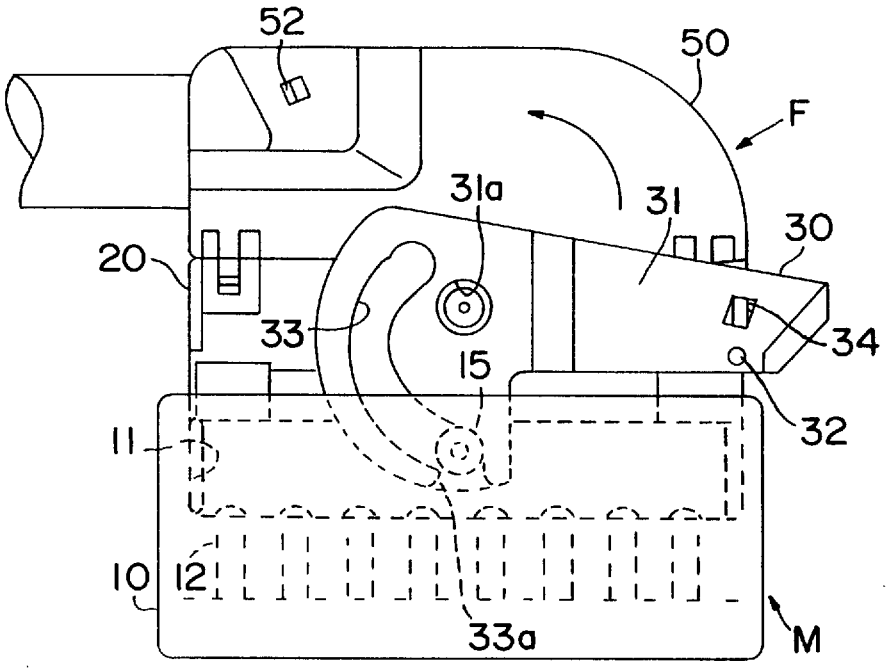
FIG. 3 is a front view showing a lever in its standby position.
Figure 4:
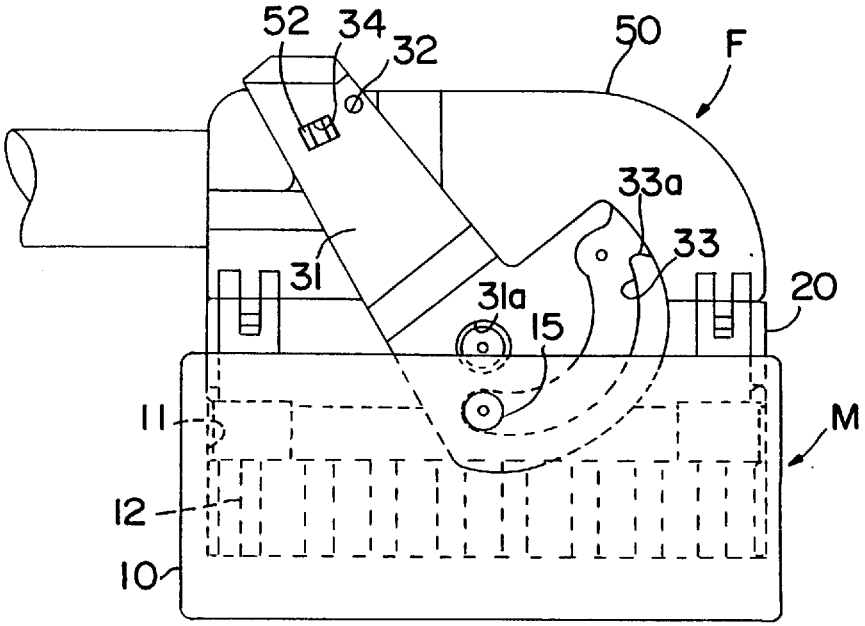
FIG. 4 is a front view showing the lever in its connection position.
Figure 5:
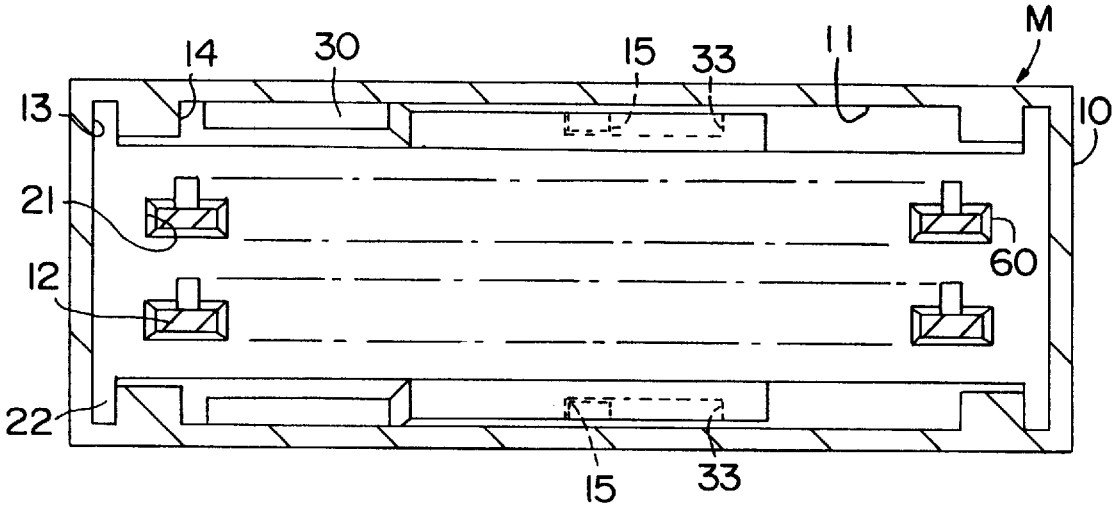
FIG. 5 is a section showing the connected state of the connector.
Figure 6:
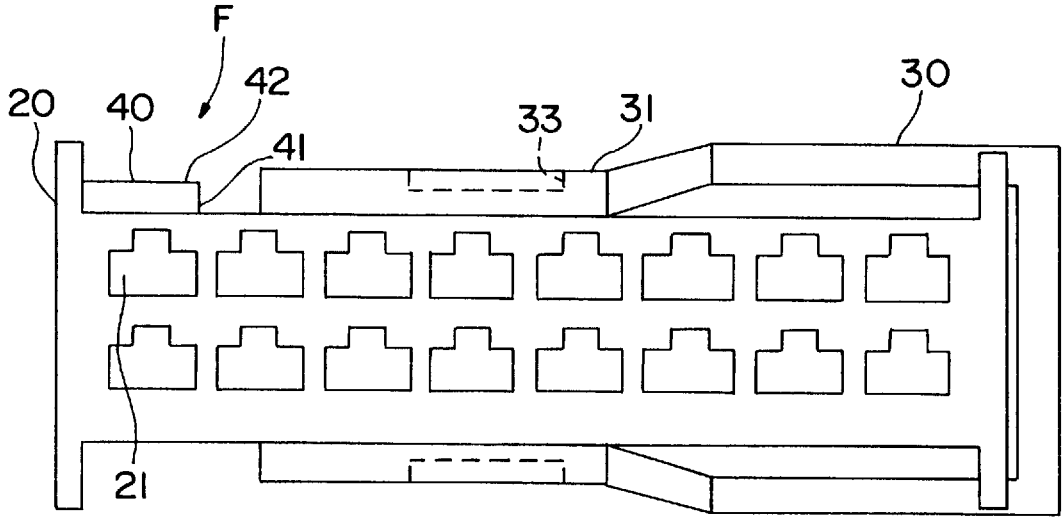
FIG. 6 is a front view of the female connector.
Figure 7:
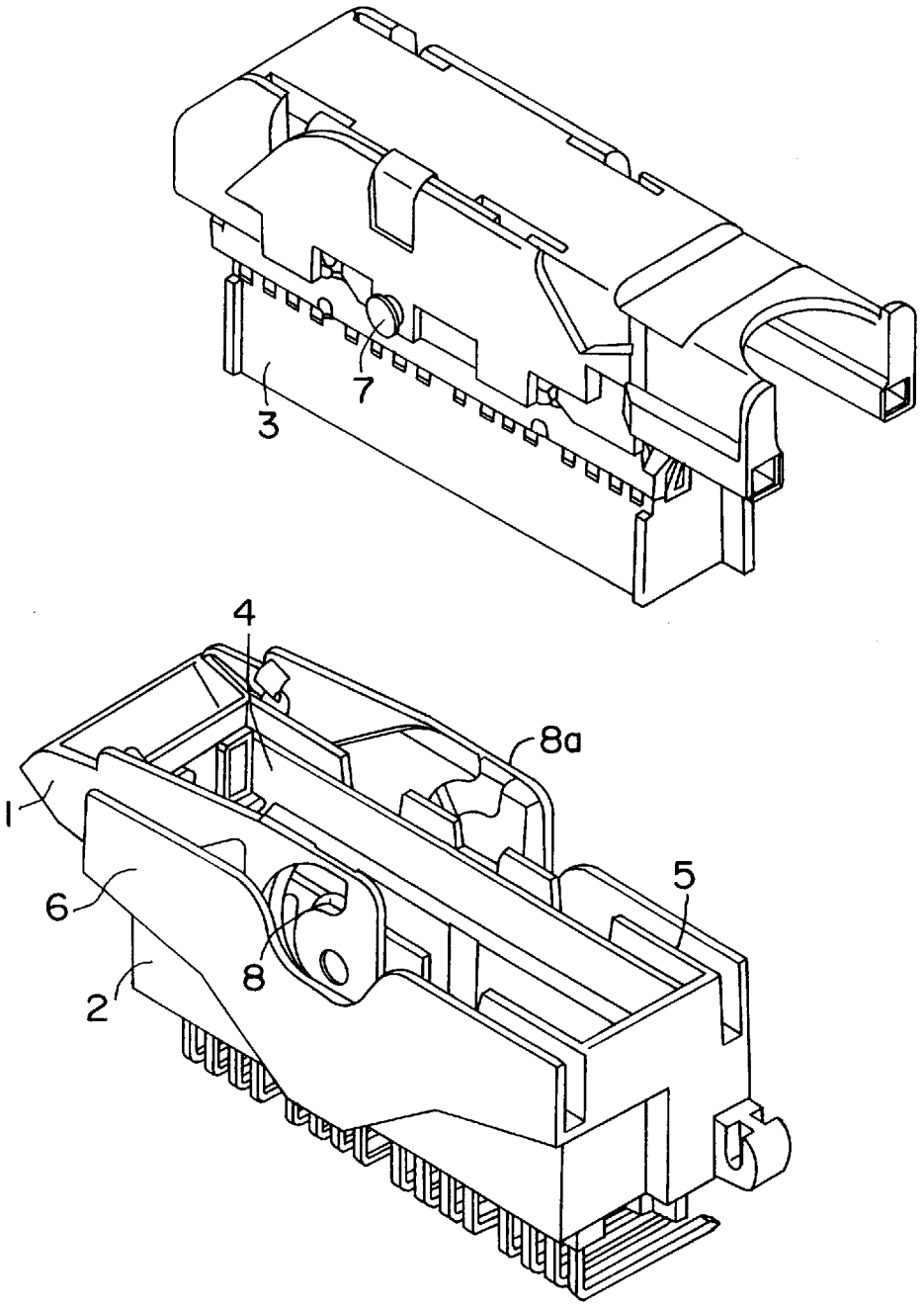
FIG. 7 PRIOR ART
FIG. 7 is a perspective view of a prior art lever connector.

Thereafter, the lever 30 is rotated to the left (in a direction of arrow in FIG. 3). As the lever 30 is rotated, the engaging pins 15 are guided along the cam grooves 33, in particular by means of the interaction surfaces thereof to substantially their rear ends. Since the cam grooves 33 approach the mount holes 31*a* as they extend toward their rear ends, the female connector housing 20 is moved into the receptacle 11 of the male connector housing 10 as the engaging pins 15 move. In other words, the male and female connector housings 10, 20 are displaced relative to each other in a connection direction by the cam effect of the one or more cam grooves 33 with respect to the engaging pins 15 or the interaction between the one or more cam grooves 33 and the one or more engaging pins 15. When the lever 30 is rotated to a position where the locking holes 34 are engaged with the locking projections 52, the female connector housing 20 is substantially completely accommodated in the receptacle 11 of the male connector housing 10. In this way, the connector housings 10, 20 are connected (see FIG. 4).

In this connected state, the bottom part of the lever 30 is accommodated in the receptacle 11 together with the female connector housing 20, i.e. a part of the legs 31 of the lever 30 is arranged between the male connector housing 10 and the female connector housing 20. Accordingly, in the connected state, the lever 30 and the outer wall of the receptacle 11 are closely located one beside the other outside the female connector housing 20, with the result that a movement of the bottom part of the lever 30 in its opening direction (outward direction) is at least partially restricted by the outer wall of the receptacle 11.

As described above, according to this embodiment, the lever 30 is mounted on the female connector housing 20. When the male and female connector housings 10, 20 are connected, a part of the lever 30 is accommodated in the receptacle 11 of the male connector housing 10 together with the female connector housing 20. Accordingly, it is not necessary to provide a protection wall for preventing the disengagement of the lever 30 in the connected state. As a result, the lever connector according to this embodiment can be made smaller than the prior art by the protection wall. Further, in this embodiment, since the cam grooves 33 are recesses formed in the outer surfaces of the lever 30, a mold for the cam grooves 33 can be pulled outward. This enables the construction of the mold to be simplified. Furthermore, since the cam grooves 33 are preferably recesses in their entirety, not through holes as in the prior art, the strength of the lever 30 is not substantially degraded by the formation of the cam grooves 33.

The invention is not limited to the foregoing embodiment, but may, for example, be embodied as follows. These embodiments are also embraced by the technical scope of the invention as defined in the claims.

Although the retainer 40 in the form of a lattice is mounted in the foregoing embodiment, a retainer of another form may be mounted or the retainer may be omitted from the construction.

Although the male connector M is so constructed as to be mounted on the base board in the foregoing embodiment, it may be of the type which is to be connected with the ends of the wires.

Although the lever 30 is described as being pivotably or pivotally mounted it may be substantially linearly displaceable or shiftable with respect to the male and/or female connector housing. In this configuration the at least one cam groove is arranged such that it may interact with at least one pin arranged at the corresponding connector housing to displace the connector housings relative to each other toward their connected position upon substantially linear displacement of the lever toward a connection position.

A variety of other changes can be made without departing the spirit and scope of the invention as defined in the claims.

Next, how the female connector F of the retainer type, in particular of the side retainer type is assembled is described. First, the retainer 40 is inserted or fitted preferably from above into the retainer receptacle 27 of the female connector housing 20 until it is held in its partly locked position. In this position, the opposite side portions 42 at the upper surface of the retainer 40 slightly project from the upper surface of the female connector housing 20, and the recess portion 41 is substantially flush with the upper surface of the female connector housing 20. The legs 31 of the lever 30 are so fitted as to hold the upper and lower surfaces of the female connector housing 20 from outside. At this time, the bottom parts of the legs 31 are located in the recess portion 41 which is substantially flush with the upper surface of the female connector housing 20 (see FIG. 6).

Thereafter, the female terminal fittings are mounted into the respective cavities 21. In this state, the respective female terminal fittings are at least partly locked by unillustrated lances or locking members. Subsequently, the retainer 40 in its partly locked position is pressed to its fully locked position. Then, the female terminal fittings are fully locked by the retainer 40. By mounting the cover 50, the assembly of the female connector F is completed.

The male and female connectors F, M may be connected as follows. With the lever 30 held in its standby position, the female connector housing 20 is fitted into the receptacle 11 of the male connector housing 10 in such a manner that the respective wrench prevention portions 22 of the female connector housing 10 are inserted into the guide grooves 13 of the male connector housing 10. Then, the engaging pins 15 of the male connector housing 10 enter the front ends of the cam grooves 33 of the lever 30 through the insertion inlets 33*a*.

Thereafter, the lever 30 is rotated to the left (in a direction of arrow in FIG. 3). As the lever 30 is rotated, the engaging pins 15 are guided along the cam grooves 33 to their rear ends. Since the cam grooves 33 approach the mount holes 31*a* as they extend toward their rear ends, the female connector housing 20 is moved into the receptacle 11 of the male connector housing 10 as the engaging pins 15 move. In other words, the male and female connector housings 10, 20 are displaced in a connection direction by the cam effect of the cam grooves 33 with respect to the engaging pins 15. When the lever 30 is rotated to a position where the locking holes 34 are engaged with the locking projections 52, the female connector housing 20 is completely accommodated in the receptacle 11 of the male connector housing 10. In this way, the connector housings 10, 20 are connected (see FIG. 4).

As described above, according to this embodiment, since the retainer 40 is formed with the recess portion 41, even if the lever 30 is so mounted as to hold the upper and lower surfaces (opposite side surfaces including the longer sides of the engaging surface with the male connector M) of the female connector housing 20 from outside, the retainer 40 in its partly locked position does not interfere with the lever 30. Since the lever 30 can be so mounted as to extend along the length of the female connector housing 20, the lever 30 does not project significantly. Therefore, the lever connector of side retainer type is allowed to have a small size.

The invention is not limited to the foregoing embodiment, but may, for example, be embodied as follows. These embodiments are also embraced by the technical scope of the invention as defined in the claims.

Although the cover 50 is mounted on the female connector housing 20 in the foregoing embodiment, it may be omitted from the construction.

Although the male connector M is so constructed as to be mounted on the base board in the foregoing embodiment, it may be of the type which is to be connected with the ends of the wires.

A variety of other changes can be made without departing the spirit and scope of the invention as defined in the claims.

What is claimed is:

1. A lever connector, comprising:

a first connector housing having a receptacle formed therein, the first connector housing further having a front end open to the receptacle such that a mating direction into the receptacle extends from the front end;

a second connector housing having a front end, portions of said second connector housing extending from said front end being engageable in the receptacle of the first connector housing;

a lever having at least one cam groove provided on the second connector housing for pivotable movement about at least one pivot pin, the cam groove having an open end substantially at the front end of the second connector housing in a first rotational orientation of the lever; and at least one engaging pin projecting from at least one wall surface of the receptacle in the first connector housing in proximity to the front end of the first connector housing, the engaging pin and the pivot pin being aligned with one another along the mating direction, the engaging pin being engageable with the open end of the cam groove in the first rotational orientation of the lever, the first and second connector housings being connectable by a cam effect of the at least one engaging pin and the at least one cam groove during rotation of the lever from the first rotational orientation; and at least a part of the lever being accommodated in the receptacle as the first and second connector housings are connected.

2. A lever connector according to claim 1, wherein the pivot pin on the second connector housing.

3. A lever connector according to claim 1, wherein the lever is mounted outside the second connector housing and the cam groove is a recess formed in an outer surface of the lever.

4. A lever connector according to claim 1, wherein holding means are provided at the second connector housing and the lever for holding the lever in a predetermined position.

5. A lever connector according to claim 1, wherein the first and second connector housings comprise tilt prevention means, which prevent a tilting of the connector housing during their connection.

6. A lever connector according to claim 1, further comprising;

a retainer which is engageable in the second connector housing, the retainer being engageable in a partly locked position in the second connector housing for permitting insertion of terminal fittings into the second connector housing, said retainer further being movable into a fully locked position for locking the terminal fittings in the second connector housing.

7. A lever connector according to claim 1, wherein the lever is aligned substantially transverse to the mating direction in the first rotational orientation of the lever and is aligned substantially parallel to the mating direction when the first and second connector housings are mated.

8. A lever connector according to claim 1, wherein the lever is disposed for rotation away from the first connector housing during mating of the first and second connector housings.

9. A lever connector according to claim 1, wherein the pivot pin, the engaging pin and the open end of the cam groove are substantially aligned with one another along the mating direction when the lever is in the first rotational orientation.

10. A lever connector according to claim 1, wherein the cam groove has a closed end and wherein the pivot pin, the engaging pin and the closed end of the cam groove are substantially aligned with one another and along the mating direction when the lever is rotated to a second rotational orientation for fully mating the first and second connector housings.

11. A lever connector according to claim 1, wherein the first and second connector housings each include a pair of opposed sides aligned substantially parallel to one another and substantially parallel to the mating direction, the pivot pin being substantially centrally disposed between the sides of the second connector housing, and the engaging pin being disposed substantially centrally between the sides of the first connector housing.

12. A lever connector according to claim 1, further comprising guide means on both the first and second connector housings for guiding the first and second connector housings substantially along the mating direction.

13. A lever connector according to claim 2, wherein the cam groove has such a configuration that its distance to the pivot center is variable in an azimuthal direction.

14. A lever connector according to claim 6, wherein the retainer slightly projects from an outer side surface of the second connector housing in the partly locked position thereof.

15. A lever connector according to claim 14, wherein the retainer is formed with a recess portion for avoiding interference with the lever in the partly locked position thereof.

16. A lever connector according to claim 15, wherein the lever is so mounted as to hold a side surface of the second connector housing where the retainer is mounted, and a side surface opposite thereto.

* * * * *